US006858176B2

(12) United States Patent
Krogerus et al.

(10) Patent No.: US 6,858,176 B2
(45) Date of Patent: Feb. 22, 2005

(54) METHOD FOR SINTERING FERROALLOY MATERIALS

(75) Inventors: Helge Krogerus, Katariinankatu (FI); Päivi Oikarinen, Nuottakallio (FI); Timo Lintumaa, Säveltäjänkatu (FI); Esko Lamula, Laviantie (FI)

(73) Assignee: Outokumpu Oyj, Espoo (FI)

( * ) Notice: Subject to any disclaimer, the term of this patent is extended or adjusted under 35 U.S.C. 154(b) by 202 days.

(21) Appl. No.: 10/148,851

(22) PCT Filed: Dec. 1, 2000

(86) PCT No.: PCT/FI00/01061

§ 371 (c)(1),
(2), (4) Date: Sep. 27, 2002

(87) PCT Pub. No.: WO01/40527

PCT Pub. Date: Jun. 7, 2001

(65) Prior Publication Data

US 2004/0071583 A1 Apr. 15, 2004

(30) Foreign Application Priority Data

Dec. 2, 1999 (FI) ..... 19992590

(51) Int. Cl.[7] ..... B22F 3/10
(52) U.S. Cl. ..... 419/3; 419/45
(58) Field of Search ..... 419/3, 45

(56) References Cited

U.S. PATENT DOCUMENTS

| | | | | | |
|---|---|---|---|---|---|
| 3,259,483 | A | | 7/1966 | Austin | |
| 4,148,627 | A | * | 4/1979 | Haley | 75/773 |
| 4,168,951 | A | | 9/1979 | Drugge | |
| 4,772,322 | A | * | 9/1988 | Bellis et al. | 75/230 |
| 5,010,050 | A | * | 4/1991 | Wullenweber et al. | 502/301 |
| 5,011,654 | A | * | 4/1991 | Mathers | 419/3 |
| 5,132,080 | A | * | 7/1992 | Pfeil | 419/2 |

FOREIGN PATENT DOCUMENTS

| | | |
|---|---|---|
| DE | 19816410 A1 | 10/1998 |
| EP | 0587947 A1 | 3/1994 |
| SE | 211 676 | 3/1967 |

* cited by examiner

*Primary Examiner*—Daniel Jenkins

(57) ABSTRACT

The invention relates to a method for sintering ferroalloy materials in a continuously operated band sintering process, in which method the pellets to be sintered are arranged on the sintering underlay as an essentially even pellet bed, which pellet bed is conveyed on the sintering underlay through the various steps of the sintering process, and in connection with the sintering process, gas is conducted through the pellet bed. According to the invention, at least the major part of the carbon-bearing material needed for heating the pellet bed up to the sintering temperature is fed onto the surface of ready-made pellets prior to bringing the pellets to the sintering step.

14 Claims, No Drawings

METHOD FOR SINTERING FERROALLOY MATERIALS

The present invention relates to a method for sintering iron oxide bearing ferroalloy materials in a continuous band sintering process and to the feeding of carbon-bearing material, used as the reducing agent, to the material to be sintered.

Carbon-bearing solid material, such as coke, is used as the source of energy in the sintering of ferroalloy materials. The quantity of carbon-bearing material required in the sintering of ferroalloy materials varies, depending on the material in question, within the range of 1–3%, when calculated from the total quantity of the ferroalloy material to be sintered. The carbon-bearing material used in the sintering process is finely divided, and it is usually added to the material to be sintered in connection with the pelletizing process, to which the material is subjected prior to sintering. In the pelletizing process, the finely divided material, the added binding agent and the carbon-bearing material are usually compressed, in a particular pelletizing drum, into pellets with the diameter of 5–18 mm, which pellets are further sintered by means of hot gas into a form where the pellets can as such be fed into a smelting furnace in order to produce the ferroalloy proper.

The carbon-bearing material that is added in connection with pelletizing is mainly located inside the pellet. In connection with sintering, the carbon-bearing material is oxidised by the oxygen contained in the gas used for sintering, and when the carbon-bearing material is located inside the pellet, it creates reducing conditions also in the interior of the pellet, where the atmosphere is usually oxidising. Now the iron oxides contained in the ferroalloy material are reduced, even into metallic form. Because the reducing reactions of the iron oxides are endothermic and thus heat-consuming, part of the carbon-bearing material is consumed in other reactions than the raising of the temperature of the sintering bed up to the sintering temperature 1300–1600° C. In case the ferroalloy material to be processed also contains hydroxides and/or carbonates, the loss of carbon in harmful reducing, heat-consuming reactions is increased.

Moreover, ferroalloy materials, such as certain chromites, may contain large amounts of oxidised trivalent iron, which is intensively reduced if the carbon employed for sintering is located inside the pellet. The same phenomenon is detected when processing ores and dusts that contain large amounts of for instance iron oxides, nickel oxides, copper oxide, cobalt oxide and other easily reduced compounds. In these cases, the use of carbon-bearing material inside the pellet to be sintered is often impossible, or carbon-bearing material can only be used in essentially small quantities.

The object of the invention is to eliminate some of the drawbacks of the prior art and to achieve an improved method, which is more advantageous with respect to the use of carbon-bearing material, in order to sinter ferroalloys so that an excessive reduction of the material to be sintered is avoided, but at the same time the use of carbon-bearing material is cut down. The essential novel features of the invention are apparent from the appended claims.

According to the invention, the ferroalloy material and the binding agent added thereto are processed, prior to sintering, advantageously in a pelletizing drum into pellets, which then are sintered by using a carbon-bearing material, advantageously in a band sintering apparatus, for example. Now the pellets to be sintered are arranged on the band of the continuously operated band sintering device in a bed with a thickness that is essentially even and with a width that is essentially equal to the width of the band sintering device, which pellet bed is then conveyed, along with the band of the band sintering device, through the various sintering steps. At least part of the carbon-bearing material required in the sintering process is fed on the pellet bed formed on the band as an essentially even layer, advantageously along the whole width of the pellet bed, prior to conveying the pellet bed to the first sintering step, i.e. the preheating step.

Part of the carbon-bearing material required in the sintering process can, according to the invention, be fed so that the carbon-bearing material is fed on the sintering underlay essentially simultaneously with the pellets that form the pellet bed, in which case the carbon-bearing material is passed to the inner areas of the pellet bed, but still onto the surface of ready-made pellets.

In the method according to the invention, the employed carbon-bearing material can be coke, wood charcoal, mineral charcoal, carbonaceous process waste or carbonaceous dust. The employed carbon-bearing material can also be a combination of various carbon-bearing materials, which combination contains at least two components from the group including coke, wood charcoal, mineral charcoal, carbonaceous process waste and carbonaceous dust.

When carbon-bearing material is fed, according to the invention, onto the band of a band sintering device, onto the surface of a pellet bed formed thereon, all of the thermal energy contained by said carbon-bearing material can be focused in the surface area of the pellet bed, and the thermal energy is transferred, through the pellet bed, along with the oxidising gas, to the inner parts of the pellet bed and further to the bottom part of the pellet bed. When the carbon-bearing material is located on the surface of the pellet bed, said material gets into contact with the oxidising gas before the oxidising gas reaches the pellet bed proper. Thus the carbon-bearing material is made to react with the oxidising gas, so that the carbon-bearing material is transformed into a gaseous form, while at the same time emitting the thermal energy contained therein to the heating of the pellet bed. In gaseous form, the carbon-bearing material is conveyed, along with the gas, through the pellet bed, thus heating the pellet bed along the whole thickness and width thereof.

By feeding at least part of the carbon-bearing material required in the sintering process onto the surface of the pellet bed to be sintered, the carbon-bearing material, as regards the portion fed onto the surface of the pellet bed, advantageously hits the pellet bed only in gaseous form. Thus the carbon-bearing material is, in its gaseous form, essentially completely in the carbon dioxide form and only to a slight amount as carbon monoxide, and therefore this type of gaseous, carbon-bearing material does essentially not function as a reducing agent to such an extent that for instance essential quantities of iron oxide should be reduced. Thus the carbon-bearing material that is transformed into gaseous form already prior to entering the inner parts of the pellet bed advantageously works only for heating the pellet bed, which as such essentially decreases the demand for carbon-bearing material.

The combustion rate of carbon-bearing material in the pellet bed can advantageously be affected by means of the particle size of the carbon-bearing material to be fed in the process. In case there is employed an essentially large particle size, for example 4–10 mm, the combustion rate of the carbon-bearing material is slowed down, and part of the material fed onto the surface of the pellet bed penetrates deeper into the pellet bed without combustion. Now the obtained temperature distribution is more even than in a case where a smaller particle size is used. With a small particle size, the combustion of a carbon-bearing material takes place essentially rapidly immediately on the surface of the pellet bed.

The combustion rate of carbon-bearing material can also be affected so that part of the carbon-bearing material is fed onto the sintering underlay essentially simultaneously with the feeding of pellets onto the sintering underlay in order to create the pellet bed to be sintered. Thus part of the carbon-bearing material is obtained on the surface of the pellets in the interior of the pellet bed. Even then, the carbon-bearing material can be fed onto the surface of ready-made pellets, in which case the carbon-bearing material in its solid form cannot essentially react with the reducible oxides located inside the pellets.

The method according to the invention can be applied for instance so that all carbon-bearing material needed in the sintering process is fed onto the surface of a ready-made pellet bed. However, the method according to the invention can also be applied so that all carbon-bearing material needed in the sintering process is fed onto the sintering underlay essentially simultaneously with the pellets that create the pellet bed. It is likewise possible to apply the method according to the invention so that part of the carbon-bearing material is fed onto the sintering underlay while forming the pellet bed, and part on the surface of the ready-made pellet bed. Moreover, the method according to the invention can, when necessary, be applied so that part, advantageously no more than 30% by weight, of the carbon-bearing material is fed already in connection with the pelletizing process, in which case said part of the carbon-bearing material is mainly transferred to the interior of the pellets. Even now the major part, at least 70% by weight of the carbon-bearing material is fed onto the surface of ready-made pellets prior to bringing the pellets to the sintering step.

Advantageously the method according to the invention is applied for iron-oxide-bearing ferroalloy materials. Moreover, the invention can be applied for instance for ferroalloy materials containing for example nickel oxide, copper oxide, cobalt oxide and other easily reducible compounds, such as hydroxides or carbonates.

What is claimed is:

1. A method of sintering ferroalloy materials in a continuously operated band sintering process, the method comprising:

arranging prepared pellets of ferroalloy material on a sintering underlay as an essentially even pellet bed;

feeding onto the surface of the prepared pellets, an amount of carbon-bearing material sufficient for heating the pellet bed to a preselected sintering temperature;

heating the pellet bed to the preselected sintering temperature while conveying the pellet bed on the sintering underlay through the sintering process; and conducting an oxidizing gas through the pellet bed, during the sintering process, to promote reaction of the carbon-bearing material and heat the pellet bed to the preselected sintering temperature.

2. A method according to claim 1, further comprising feeding at least part of the carbon-bearing material onto an upper surface of the pellet bed.

3. A method according to claim 1 or 2, further comprising feeding at least part of the carbon-bearing material onto the sintering underlay essentially simultaneously with the pellets that form the pellet bed.

4. A method according to claim 1, further comprising feeding part of the carbon-bearing material onto the surface of the pellet bed, and feeding part of the carbon-bearing material among the pellets in connection with the feeding of the pellets forming the pellet bed.

5. A method according to claim 1, wherein at least 70% by weight of the carbon-bearing material needed in the sintering process for heating the pellet bed to a preselected sintering temperature, is fed onto the surface of ready-made pellets prior to bringing the pellets to the sintering temperature.

6. A method according to claim 1, wherein the rate at which the carbon-bearing material is reacted is adjusted by preselecting the particle size of the carbon-bearing material.

7. A method according to claim 1, wherein the rate at which the carbon-bearing material is reacted is adjusted by arranging a preselected amount of the carbon-bearing material among the pellets.

8. A method according to claim 1 or 2, wherein the carbon-bearing material is coke.

9. A method according to claim 1 or 2, wherein the carbon-bearing material is wood charcoal.

10. A method according to claim 1 or 2, wherein the carbon-bearing material is mineral charcoal.

11. A method according to claim 1 or 2, wherein the carbon-bearing material is carbonaceous process waste.

12. A method according to claim 1 or 2, wherein the carbon-bearing material is carbonaceous dust.

13. A method according to claim 1 or 2, wherein the carbon-bearing material is a combination of various carbon-bearing materials, containing at least two components selected from the group consisting of coke, wood charcoal, mineral charcoal, carbonaceous process waste and carbonaceous dust.

14. A method according to claim 1, wherein up to 30% by weight of the carbon-bearing material needed in the sintering process for heating the pellet bed to a preselected sintering temperature, is contained within the prepared pellets.

* * * * *